US009012120B2

(12) United States Patent
Oshiba et al.

(10) Patent No.: US 9,012,120 B2
(45) Date of Patent: Apr. 21, 2015

(54) PRODUCTION PROCESS OF TONER FOR ELECTROSTATIC IMAGE DEVELOPMENT

(71) Applicants: Tomomi Oshiba, Tokyo (JP); Tomoko Mine, Tokyo (JP); Hitomi Motani, Tokyo (JP); Saburou Hiraoka, Tokyo (JP)

(72) Inventors: Tomomi Oshiba, Tokyo (JP); Tomoko Mine, Tokyo (JP); Hitomi Motani, Tokyo (JP); Saburou Hiraoka, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 160 days.

(21) Appl. No.: 13/693,100

(22) Filed: Dec. 4, 2012

(65) Prior Publication Data

US 2014/0011132 A1 Jan. 9, 2014

(30) Foreign Application Priority Data

Dec. 12, 2011 (JP) ..... 2011-271132

(51) Int. Cl.
*G03G 9/08* (2006.01)
*G03G 9/087* (2006.01)

(52) U.S. Cl.
CPC ..... *G03G 9/0802* (2013.01); *G03G 9/0804* (2013.01); *G03G 9/08755* (2013.01); *G03G 9/08795* (2013.01)

(58) Field of Classification Search
CPC ..... G03G 9/0804
USPC ..... 430/137.14
See application file for complete search history.

(56) References Cited

U.S. PATENT DOCUMENTS 6,495,302 B1 * 12/2002 Jiang et al. ..... 430/137.14

FOREIGN PATENT DOCUMENTS

| | | |
|---|---|---|
| JP | 2003-066648 | 3/2003 |
| JP | 2010-096950 | 4/2010 |
| JP | 2011-197192 | 10/2011 |

OTHER PUBLICATIONS

American Chemical Society (ACS) File Registry No. 115-41-3 on STN, copyright 2014, which was entered in STN on Nov. 16, 1984.*
American Chemical Society (ACS) File Registry No. 130-22-3 on STN, copyright 2014, which was entered in STN on Nov. 16, 1984.*
American Chemical Society (ACS) File Registry No. 149-45-1 on STN, copyright 2014, which was entered in STN on Nov. 16, 1984.*
American Chemical Society (ACS) File Registry No. 1571-36-4 on STN, copyright 2014, which was entered in STN on Nov. 16, 1984.*
American Chemical Society (ACS) File Registry No. 480-41-1 on STN, copyright 2014, which was entered in STN on Nov. 16, 1984.*
American Chemical Society (ACS) File Registry No. 10236-47-2 on STN, copyright 2014, which was entered in STN on Nov. 16, 1984.*
American Chemical Society (ACS) File Registry No. 520-33-2 on STN, copyright 2014, which was entered in STN on Nov. 16, 1984.*
American Chemical Society (ACS) File Registry No. 520-26-3 on STN, copyright 2014, which was entered in STN on Nov. 16, 1984.*
Chinese Office Action, Application No. 201210533639.7. Date of Issuance: Jun. 4, 2014 and English translation thereof.

* cited by examiner

*Primary Examiner* — Janis L Dote
(74) *Attorney, Agent, or Firm* — Lucas & Mercanti, LLP

(57) ABSTRACT

The production process is a process for producing a toner for electrostatic image development. The process has an aggregating step of adding an aggregating agent composed of a compound having a divalent or trivalent metal element into a dispersion with fine particles of a binder resin dispersed in an aqueous medium, and an aggregation terminating step of adding an aggregation terminating agent into the dispersion. The aggregation terminating agent is composed of a compound having at least one of a structure (1) represented by a formula (1) and a structure (2) represented by a formula (2). In the formulae (1) and (2), $R^1$ to $R^9$ each independently represent a hydrogen atom, a hydroxy group or an organic group. At least one of $R^1$ and $R^4$ or at least one of $R^5$ and $R^6$ represents a hydroxy group.

FORMULA (1)

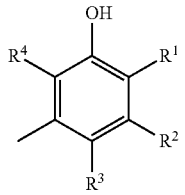

FORMULA (2)

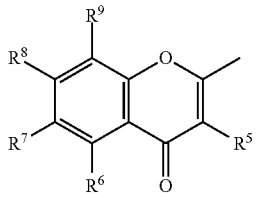

26 Claims, No Drawings

PRODUCTION PROCESS OF TONER FOR ELECTROSTATIC IMAGE DEVELOPMENT

CROSS REFERENCE TO RELATED APPLICATION

This Application claims the priority of Japanese Patent Application No. 2011-271132 filed on Dec. 12, 2011 and which is incorporated by reference herein.

TECHNICAL FIELD

The present invention relates to a production process or a toner for electrostatic image development, which is used in image formation of an electrophotographic system.

BACKGROUND

As a production process of a toner for electrostatic image development (which hereinafter may be simply referred to as a "toner"), a polymerization method has such advantages that, as compared to a grinding method and the like, the energy required for the production is small, a toner can be miniaturized in particle size, and generation of fine components can be suppressed.

As the polymerization method, a suspension polymerization method, an emulsion aggregation method, and the like are known. Especially, an emulsion aggregation method, is preferably adopted since a shape can be easily controlled.

The emulsion aggregation, method includes an aggregating step followed by an aggregation terminating step. In the aggregating step, fine particles of a binder resin produced by an emulsion polymerization, and the like, and other toner components such as fine particles of a colorant are aggregated using an aggregating agent. In the aggregation terminating step, the aggregation of the fine particles of the binder resin is terminated using an aggregation terminating agent. As the aggregating agent and the aggregation terminating agent used in the aggregating step and the aggregation terminating step, metal salts and the like are generally used (see Patent Literature 1).

However, when metal, salts are used as the aggregating agent or the aggregation terminating agent, the metal elements derived from the metal salts come to be remained in the aggregated particles. Since a compound containing such metal elements has sometimes high hygroscopicity, the resultant toner also has high hygroscopicity in such a case. As a result, a charge amount of the toner is varied depending on a certain environmental condition of image forming processing, and thus a problem arises that image defects occur. Specifically, when printing is performed in a large amount under a high-temperature and high-humidity environment, image defects such as fogging and image density reduction are caused.

CITATION LIST

Patent Literature

Patent Literature 1: Japanese Patent Application Laid-Open No. 2003-66648

SUMMARY OF INVENTION

Technical Problem

The present invention has been made in view of the foregoing circumstances and has as its object the provision of a process of producing a toner for electrostatic image development, by which a particle size and a particle size distribution can be effectively controlled, and also the resulting toner has excellent charging characteristics.

Solution to Problem

To achieve at least one of the abovementioned objects, a production process of a toner for electrostatic image development, which is composed of toner particles containing a binder resin, the process comprising:

an aggregating step of adding an aggregating agent composed of a compound having a divalent or trivalent metal element into a dispersion in which fine particles of the binder resin have been dispersed in an aqueous medium, thereby aggregating the fine particles of the binder resin to form the aggregated particles; and an aggregation terminating step of adding an aggregation terminating agent into an aggregating system of the aggregated particles, thereby terminating the growth of the aggregated particles, wherein the aggregation terminating agent is composed of a compound having at least one of a structure (1) represented by a formula (1) below and a structure (2) represented by a formula (2) below,

FORMULA (1)

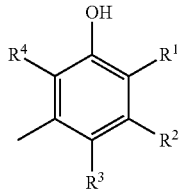

[In the formula (1), $R^1$ to $R^4$ each represent a hydrogen atom, a hydroxy group or an organic group, and these may be the same or different from each other. However, at least one of $R^1$ and $R^4$ represents a hydroxy group. Also, at least two of $R^1$ to $R^3$ may be bonded together to form a monocyclic structure or a polycyclic structure.]

FORMULA (2)

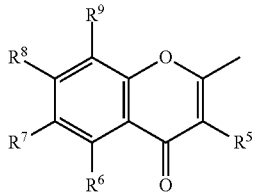

[In the formula (2), $R^5$ to $R^9$ each independently represent a hydrogen atom, a hydroxy group or an organic group. However, at least one of $R^5$ and $R^6$ represents a hydroxy group.]

In the production process of the toner for electrostatic image development according to the present invention, the aggregating agent is preferably composed of Fe, Zn or Al as the divalent or trivalent metal element.

In the production process of the toner for electrostatic image development according to the present invention, the aggregation terminating agent is preferably any one of catechin, epicatechin, epigallocatechin, epigallocatechin gallate, chlorogenic acid, ellagic acid, pyrogallol, catechol, 1,2,3,5-tetrahydroxybenzene, hexahydroxybenzene, morin, kaempferol, naringenin, naringin, hesperetin, hesperidin, apigenin, diosmin, quercetin, rutin and myrlectin.

Also, the aggregation, terminating agent is preferably composed of a compound having both the structure (1) and the structure (2). In particular, the aggregation terminating agent is preferably any one of quercetin, rutin and myricetin.

Also, the aggregation terminating agent is preferably composed of a compound having a structure in which $R^1$ and $R^4$ each are a hydroxy group in the formula (1). In particular, the aggregation terminating agent is preferably any one of epigallocatechin, epigallocatechin gallate, pyrogallol, 1,2,3,5-tetrahydroxybenzene and hexahydroxybenzene.

In the production process of the toner for electrostatic image development according to the present invention, the amount of the aggregation terminating agent added into the aqueous medium is preferably 1 to 1.000 mmol per 1 L of the aqueous medium in the aggregating system. In particular, the amount is preferably 4 to 400 mmol per 1 L of the aqueous medium in the aggregating system.

Also, the amount of the aggregating agent added into the aqueous medium is preferably 1 to 500 mmol per 1 L of the aqueous medium in the dispersion.

In the production process of the toner for electrostatic image development according to the present, invention, the aggregating agent is preferably polysilicato-iron.

In the production process of the toner for electrostatic image development according to the present invention, the average particle size of the fine particles of the binder resin in the dispersion preferably falls within a range of 20 to 400 nm in terms of a volume-based median diameter.

Also, in the production process of the toner for electrostatic image development according to the present invention, a polyester resin having an acid value of 40 mg KOH/g or less and a hydroxyl value of 60 mg KOH/g or less is preferably used as the binder resin.

Advantageous Effects of Invention

In the production process of the toner for electrostatic image development according to the present invention, a compound, (hereinafter may also be referred to as a "compound having a specific structure") having at least one of the structure (1) represented by the formula (1) and the structure (2) represented by the formula (2) is used as the aggregation terminating agent in the aggregation terminating step. Therefore, excellent aggregation-relaxing effect can be obtained, and as a result, the particle size and the particle size distribution can be effectively controlled. Also, the aggregation terminating agent does not contain metal salts, thereby reducing the amount of metal salts used during the production process, so that the content of metal elements derived from the metal salts contained in the resultant toner is reduced. Thus, a toner having excellent charging characteristics can be produced.

DESCRIPTION OF EMBODIMENTS

The present invention will hereinafter be described in detail.

Production Process of Toner:

The production process of the toner according to the present invention is a process for producing a toner composed of toner particles containing at least a binder resin and optionally containing a toner component such as a colorant, a parting agent, a charge control agent and the like, said process having an aggregating step of adding an aggregating agent composed of a compound having a divalent or trivalent metal element into a dispersion in which at least fine particles of the binder resin (hereinafter may also be referred to as "fine binder resin particles") have been dispersed in an aqueous medium, thereby aggregating the fine binder resin particles to form the resultant aggregated particles, and an aggregation terminating step of adding a compound having a specific structure as an aggregation terminating agent into an aggregating system of the aggregated particles, thereby terminating the growth of the aggregated particles.

Here, the term, "aqueous medium" means a medium composed of 50 to 100% by mass of water and 0 to 50% by mass of a water-soluble organic solvent. As examples of the water-soluble organic solvent, may be mentioned methanol, ethanol, isopropanol, butanol, acetone, methyl ethyl ketone, and tetrahydrofuran, and it is preferably an organic solvent that does not dissolve the fine binder resin particles.

A specific example of the production process of the toner according to the present invention will be described. For example, when toner particles which contain a colorant, a parting agent and a charge control agent as a toner component are obtained, the process comprises the following:

(1) a fine colorant particle dispersion-preparing step of preparing a dispersion (hereinafter may also be referred to as a "fine colorant particle dispersion") with fine particles of a colorant (hereinafter may also be referred to as "fine colorant particles") dispersed in an aqueous medium;

(2) a fine binder resin particle dispersion-preparing step of preparing a dispersion (hereinafter may also be referred to as a "fine binder resin particle dispersion") with fine binder resin particles containing a parting agent and a charge control agent dispersed in an aqueous medium;

(3) an aggregating step of adding an aggregating agent composed of a compound having a divalent or trivalent metal element into a dispersion with fine colorant particles and fine binder resin particles dispersed in the aqueous medium, thereby aggregating the fine colorant particles and the fine binder resin particles to form the resultant aggregated particles;

(4) an aggregation terminating step of adding a compound having a specific structure as an aggregation, terminating agent into an aggregating system of the aggregated particles, thereby terminating the growth of the aggregated particles;

(5) an aging step of aging the aggregated, particles with thermal energy, thereby controlling the shape thereof to form toner particles;

(6) a filtering and washing step of separating the toner particles from the dispersion system of the toner particles by filtration and removing the aggregating agent, the aggregation terminating agent, a surfactant, and the like from the toner particles; and (7) a drying step of drying the toner particles subjected to the washing treatment.

The process may comprise the following steps, if necessary;

(8) an external additive adding step of adding an external additive to the toner particles subjected to the drying treatment.

(1) Fine Colorant Particle Dispersion-Preparing Step:

This fine colorant particle dispersion-preparing step is optionally conducted when the colorant is introduced into the toner particles.

The fine colorant particle dispersion is obtained by dispersing the colorant in an aqueous medium.

Publicly known various methods such as use of a dispersing machine may be adopted as a dispersing method.

The average particle size of the fine colorant particles in the fine colorant particle dispersion preferably falls within a range of, for example, 10 to 300 nm in terms of a volume-based median diameter.

In the present invention, the volume-based median diameter of the fine colorant particles is measured by means of an electrophoretic light scattering spectrophotometer "ELS-800" (manufactured by Otsuka Electronics Co., Ltd.).

Colorant:

As the colorant contained in the toner particles, may be used publicly known various colorants such as carbon black, black iron oxide, dyes and other pigments.

Examples of the carbon black include channel black, furnace black, acetylene black, thermal black and lamp black. Examples of the black iron oxide include magnetite, hematite and iron titanium trioxide.

Examples of the dyes include C.I. Solvent Red: 1, 49, 52, 58, 63, 111 and 122; C.I. Solvent Yellow: 19, 44, 17, 79, 81, 82, 93, 98, 103, 104, 112 and 162; and C.I. Solvent Blue: 25, 36, 60, 70, 93, and 95.

Examples of the other pigments include C.I. Pigment Red; 5, 48:1, 48:3, 53:1, 57:1, 81:4, 122, 139, 144, 149, 150, 166, 177, 178, 222, 238 and 269; C.I. Pigment Orange: 31 and 43; C.I. Pigment Yellow: 14, 17, 74, 93, 94, 138, 155, 156, 158, 180 and 185; C.I. Pigment. Green 7; and C.I. Pigment Blue: 15:3 and 60.

As a colorant for obtaining a toner of each color, colorants for each color may be used either singly or in any combination thereof.

The content of the colorant in the toner particles is preferably 1 to 10% by mass, more preferably 2 to 8% by mass based on the toner particles.

If the content of the colorant is too small, desired tinting strength may possibly be not attained to the resulting toner. If the content of the colorant is too large on the other hand, isolation of the colorant or its adhesion to a carrier or the like may occur in some cases to exert an influence on charge property.

A method, for introducing the colorant into the toner particles is not limited to the method like this embodiment, in which the fine colorant particles formed, of the colorant alone are prepared separately from the fine binder resin particles, and these fine particles are aggregated. For example, a method, in which a dispersion of fine binder resin particles, in which the colorant has been contained, is prepared in the fine binder resin particle dispersion-preparing step, and these colorant-containing fine binder resin particles are aggregated, may also be selected.

Dispersing Agent:

In the fine colorant particle dispersion-preparing step, a dispersing agent may be added in an aqueous medium. As the dispersing agent, may be used conventionally known various surfactants and the like.

(2) Fine Binder Resin Particle Dispersion-Preparing Step:

The fine binder resin particles may be produced by a production process publicly known in the technical field of toners, for example, an emulsion polymerization process, a phase inversion emulsification process, a suspension polymerization process or a dissolution suspension process. Among these, the production process by the emulsion polymerization process is preferred.

In the emulsion polymerization process, a polymerizable monomer to obtain, the binder resin is dispersed in an aqueous medium to form emulsion particles, and a polymerization initiator is then added to polymerize the polymerizable monomer, thereby forming fine binder resin particles.

Binder Resin:

As the binder resin making up the toner particles, may be used publicly known various resins such as vinyl resins such as styrene resins, (meth)acrylic resins, styrene-(meth)acrylic copolymer resins and olefin resins, polyester resins, polyamide resins, polycarbonate resins, polyether, polyvinyl acetate resins, polysulfone, epoxy resins, polyurethane resins, and urea resins. These resins may be used either singly or in any combination thereof.

When a vinyl resin is used as the binder resin, examples of the polymerizable monomer to obtain the binder resin include the following.

(1) Styrene and Derivatives Thereof:

styrene, o-methylstyrene, m-methylstyrene, p-methylstyrene, α-methylstyrene, p-phenylstyrene, p-ethylstyrene, 2,4-dimethyl styrene, p-tert-butylstyrene, p-n-hexylstyrene, p-n-octylstyrene, p-n-nonylstyrene, p-n-decylstyrene, p-n-dodecylstyrene and derivatives thereof.

(2) Methacrylic Ester and Derivatives Thereof:

methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, dimethylaminoethyl methacrylate and derivatives thereof.

(3) Acrylic Ester and Derivatives Thereof;

methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate and derivatives thereof.

(4) Olefins;

ethylene, propylene and isobutylene, (5) Vinyl Esters:

vinyl propionate, vinyl acetate and vinyl benzoeate.

(6) Vinyl Ethers:

vinyl methyl ether and vinyl ethyl ether.

(7) Vinyl Ketones:

vinyl methyl ketone, vinyl ethyl ketone and vinyl hexyl ketone.

(8) N-Vinyl Compounds:

N-vinylcarbazole, N-vinylindole and N-vinylpyrrolidone.

(9) Other Monomers:

vinyl compounds such as vinylnaphthalene and vinylpyridine, and acrylic acid and methacrylic acid derivatives such as acrylonitrile, methacrylonitrile and acrylamide.

In addition, as the polymerizable monomer to obtain the vinyl resin, may be used a monomer having an ionic leaving group such as a carboxyl group, a sulfonic group or a phosphate group. Specifically, the following monomers are mentioned.

Examples of polymerizable monomers having a carboxyl group include acrylic acid, methacrylic acid, maleic acid, itaconic acid, cinnamic acid, fumaric acid, monoalkyl esters of maleic acid and monoalkyl esters of itaconic acid. Examples of polymerizable monomers having a sulfonic group include styrenesulfonic acid, allylsulfosuccinic acid, and 2-acrylamido-2-methylpropanesulfonic acid. In addition, examples of polymerizable monomers having a phosphate group include acid phosphooxy-ethyl methacrylate.

Polyfunctional vinyl compounds may also be used as the polymerizable monomer to obtain the vinyl resin, whereby the vinyl resin having a crosslinked structure is formed. Examples of the polyfunctional vinyl compounds include divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate and neopentyl glycol diacrylate.

Polymerization Initiator:

When a polymerization initiator is used in the fine binder resin particle dispersion-preparing step, conventionally known various polymerization initiators may be used.

As preferable specific examples of usable polymerization initiators, may be mentioned persulfates (potassium persulfate, ammonium persulfate, etc.). In addition, azo compounds (4,4'-azobis-4-cyanovaleric acid and salts thereof, 2,2'-azobis (2-amidinopropane) salts, etc.), peroxide compounds, and azobisisobutyronitrile, etc. may also be used.

Chain Transfer Agent:

A generally used chain transfer agent may be used, in the fine binder resin particle dispersion-preparing step for the purpose of controlling the molecular weight of the binder resin.

No particular limitation is imposed on the chain transfer agent. As examples thereof, may be mentioned 2-chloroethanol, mercaptans such as octylmercaptan, dodecylmercaptan and t-dodecylmercaptan, and styrene dimer.

When the polyester resin is used as the binder resin, a polyvalent carboxylic acid and derivatives thereof as well as a polyhydric alcohol and derivatives thereof are used as polymerizable monomers for forming the binder resin.

As the polyvalent carboxylic acid and derivatives thereof, may be mentioned, for example, dicarboxylic acids such as oxalic acid, malonic acid, succinic acid, glutaric acid, adipic acid, pimelic acid, suberic acid, azelaic acid, sebacic acid, maleic acid, fumaric acid, citraconic acid, itaconic acid, glutaconic acid, n-dodecylsuccinic acid, n-dodecenylsuccinic acid, isododecylsuccinic acid, isododecenylsuccinic acid, n-octylsuccinic acid and n-octenylsuccinic acid; aromatic dicarboxylic acids such as phthalic acid, isophthalic acid, terephthalic acid and naphthalenedicarboxylic acid; trivalent or still higher carboxylic acids such as trimellitic acid, and pyromellitic acid; and anhydrides and chlorides thereof. These compounds may be used either singly or in any combination thereof.

As the polyhydric alcohol and derivatives thereof, may be mentioned, for example, diols such as ethylene glycol, diethylene glycol, triethylene glycol, 1,2-propylene glycol, 1,3-propylene glycol, 1,4-butanediol, 1,4-butylenediol, neopentyl glycol, 1,5-pentane glycol, 1,6-hexane glycol, 1,7-heptane glycol, 1,8-octanediol, 1,9-nonanediol, 1,10-decanediol, pinacol, cyclopentane-1,2-diol, cyclohexane-1,4-diol, cyclohexane-1,2-diol, cyclohexane-1,1-dimethanol, dipropylene glycol, polyethylene glycol, polypropylene glycol, polytetramethylene glycol, bisphenol A, bisphenol Z and hydrogenated bisphenol A; trihydric or still higher aliphatic alcohols such as glycerol, trimethylolethane, trimethylolpropane, pentaerythritol, sorbitol, trisphenol PA, phenol novolak and cresol novolak; and alkylene oxide adducts of the above-mentioned trihydric or still higher aliphatic alcohols. These compounds may be used either singly or in any combination thereof.

When the polyester resin is used as the binder resin, it is preferred that the polyester resin has an acid value of 40 mg KOH/g or less and a hydroxyl value of 60 mg KOH/g or less.

The acid value and hydroxyl value of the polyester resin are values measured according to the respective usual, methods.

Surfactant:

In the fine binder resin particle dispersion-preparing step, a surfactant may also be added into the aqueous medium, and conventionally known various anionic: surfactants, cationic surfactants and nonionic surfactants may be used, as the surfactant.

The fine binder resin particles may be formed as that having a two or more multilayer structure composed of resins different in composition from each other. In this case, a process in which a polymerization initiator and a polymerizable monomer are added into a fine resin particle dispersion prepared by an emulsion polymerization treatment (first-stage polymerization) according to a method known, per se in the art, and this system is subjected to a polymerization treatment (second-stage polymerization) may be adopted.

The average particle size of the fine binder resin particles obtained in the fine binder resin particle dispersion-preparing step is preferably within a range of 20 to 400 nm in terms of a volume-based median diameter.

In the present invention, the volume-based median diameter of the fine binder resin particles is a value measured by means of an electrophoretic light scattering spectrophotometer "ELS-800" (manufactured by Otsuka Electronics Co., Ltd.).

When the parting agent or the charge control agent is contained in the toner particles, they may be added in the fine binder resin particle dispersion-preparing step.

Parting Agent:

When the parting agent is contained in the toner particles, no particular limitation is imposed on the parting agent, and as examples thereof, may be used polyethylene wax, oxidized type polyethylene wax, polypropylene wax, oxidized type polypropylene wax, carnauba wax, paraffin wax, microcrystalline wax, Fischer-Tropsch wax, rice wax, candelilla wax and fatty acid esters.

The content of the parting agent is generally 0.5 to 25 parts by mass, preferably 3 to 15 parts by mass per 100 parts by mass of the binder resin.

Charge Control Agent:

When the charge control agent is contained in the toner particles, publicly known various compounds may be used as the charge control, agent.

The content of the charge control agent is generally 0.1 to 10 parts by mass, preferably 0.5 to 5 parts by mass per 100 parts by mass of the binder resin.

(3) Aggregating Step:

This aggregating step is a step of adding an aggregating agent composed of a compound having a divalent or trivalent metal element into a dispersion in which fine colorant particles and fine binder resin particles have been dispersed in an aqueous medium, thereby aggregating the fine binder resin particles and the fine colorant particles to form the resultant aggregated particles.

In this aggregating step, heating at a temperature equal to or higher than the glass transition point of the binder resin may be performed over the entire step or in an appropriate period of the step, thereby fusion-bonding each of the fine binder resin particles making up the aggregated particles.

Aggregating Agent:

In the aggregating step in the present invention, a compound having a divalent or trivalent metal element, is used as the aggregating agent.

As an aggregating agent, may be mentioned, for example, water-soluble metal salts having a divalent or trivalent metal element and hydrates thereof, polysilicato-iron and polyaluminum chloride.

As the water-soluble metal salts having a divalent or trivalent metal element, may be mentioned, for example, divalent metal salts such as magnesium chloride, calcium, chloride, zinc chloride, copper sulfate, magnesium sulfate and manganese sulfate; and trivalent metal salts such as aluminum chloride and aluminum sulfate.

Polysilicato-iron is a compound represented by a general formula $[SiO_2]_n.[Fe_2O_3]$ and having an average molecular weight of the order of 200,000 to 500,000 daltons, in which iron is introduced into a stable polymerized silicic acid.

By using this polysilicato-iron, higher cohesive force than the single use of the other iron-based aggregating agent such as iron(II) chloride is developed by virtue of a charge-neutralizing action derived from iron, and a crosslinking action by polymerized silicic acid.

The polysilicato-iron is preferably that having a molar ratio (Si/Fe) of silica to iron within a range of 0.25 to 3.0, and particularly preferably that having a molar ratio within a range of 0.25 to 1.0 from the viewpoint of the ability to control the particle size distribution of the aggregated particles.

These aggregating agents may be used either singly or in any combination thereof.

As the aggregating agent, that including Fe, Zn or Al as a divalent or trivalent metal element is preferable from the view point of the ability to control the particle size upon the aggregation.

The amount of the aggregating agent added into the aqueous medium is preferably 1 to 500 mmol, more preferably 2 to 200 mmol per 1 L of the aqueous medium in the dispersion. When the aggregating agent is polysilicato-iron, the amount is preferably 1 to 100 mmol, more preferably 2 to 50 mmol in terms of $[Fe_2O_3]$ per 1 L of the aqueous medium, in the dispersion.

In the aggregating step, no particular limitation is imposed on the temperature of the dispersion at the time the aggregating agent is added, but the temperature is preferably equal to or lower than the glass transition point of the binder resin.

In the aggregating step, the pH of the dispersion is preferably controlled to 7 or lower. If the pH of the dispersion is higher than 7, the occurrence of coarse particles cannot, be inhibited upon the aggregation, and therefore, there is a possibility that the particle size distribution of the resulting toner may become broad.

(4) Aggregation Terminating Step:

The aggregation terminating step is a step of adding a compound having a specific structure as an aggregation terminating agent into the aggregating system of the aggregated particles at the time the aggregated particles have come to have a desired particle size in the aggregating step as above, thereby lowering the cohesive force between or among the fine binder resin particles in the aggregated particles to terminate the growth of the particle size of the aggregated particles.

Aggregation Terminating Agent:

In the aggregation terminating step in the present invention, a compound having at least one of a structure (1) represented by the above formula (1) and a structure (2) represented by the above formula (2) is used as the aggregation terminating agent.

In the present invention, the compound having the specific structure is used, as the aggregation terminating agent, so that the compound having the specific structure can exert a chelate effect, thereby effectively terminating the growth of the aggregated particles.

No particular limitation is imposed on the aggregation terminating agent, as long as it has at least one of the structure (1) and the structure (2).

In the formula (1) which represents the structure (1), $R^1$ to $R^4$ each represent a hydrogen atom, a hydroxy group or an organic group, and these may be the same or different from each other. However, at least one of $R^1$ and $R^4$ represents a hydroxy group. Also, at least two of $R^1$ to $R^4$ may be bonded together to form a monocyclic structure or a poly cyclic structure.

In the formula (1), no particular limitation is imposed on the organic group represented by $R^1$ to $R^4$, but as examples thereof, may be mentioned an alkyl group, an alkenyl group, an alkynyl group, an aryl group or a heterocyclic group, an alkoxy group, a glucosyl group, a rutinosyl group, a rhamnosyl group, a substituted alkoxy group and a substituted acyloxy group.

A compound having a structure (1,2,3-trihydroxybenzene structure), in which $R^1$ and $R^4$ in the formula (1) each are a hydroxy group, is preferably used as the aggregation terminating agent, from, the view point of the ability to control the particle size.

In the formula (2) which represents the structure (2), $R^5$ to $R^9$ each independently represent a hydrogen atom, a hydroxy group or an organic group. However, at least one of $R^5$ and $R^6$ represents a hydroxy group.

In the formula (2), no particular limitation is imposed on the organic group represented by $R^5$ to $R^9$, but as examples thereof, may be mentioned an alkyl group, an alkenyl group, an alkynyl group, an aryl group or a heterocyclic group, an alkoxy group, a glucosyl group, a rutinosyl group, a rhamnosyl group, a substituted alkoxy group, and a substituted acyloxy group.

As the compound having the structure (1) as the aggregation terminating agent, may be mentioned the below-described example compounds (1-1) to (1-10). Specific examples thereof include catechin (example compound (1-1)), epicatechin (example compound (1-2)), epigaliocatechin (example compound (1-3)), epigallocatechin gallate (example compound (1-4)), chlorogenic acid (example compound (1-5)), ellagic acid (example compound (1-6)), pyrogallol (example compound (1-7)), catechol (example compound (1-8)), 1,2,3,5-tetrahydroxybenzene (example compound (1-9)) and hexahydroxybenzene (example compound (1-10)).

EXAMPLE COMPOUND (1-1)

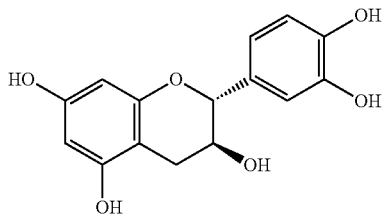

EXAMPLE COMPOUND (1-2)

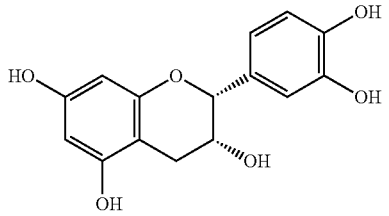

-continued

EXAMPLE COMPOUND (1-3)

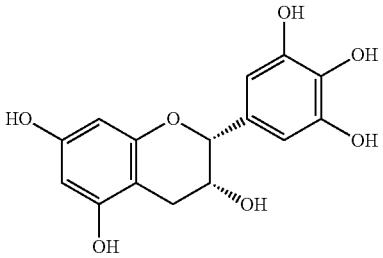

EXAMPLE COMPOUND (1-4)

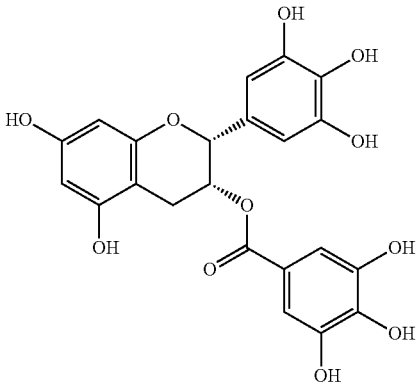

EXAMPLE COMPOUND (1-5)

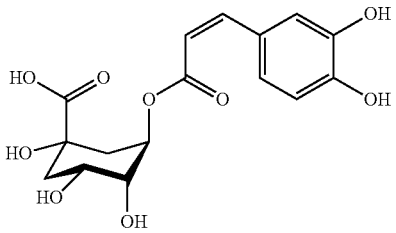

EXAMPLE COMPOUND (1-6)

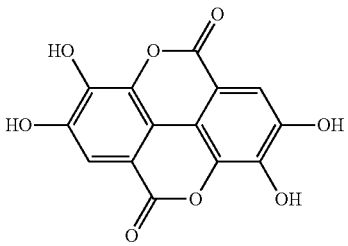

EXAMPLE COMPOUND (1-7)

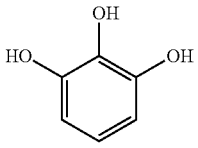

EXAMPLE COMPOUND (1-8)

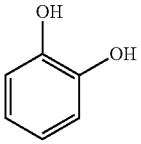

-continued

EXAMPLE COMPOUND (1-9)

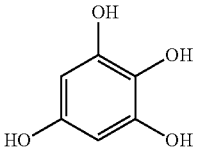

EXAMPLE COMPOUND (1-10)

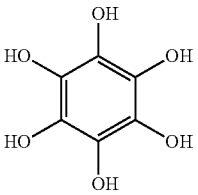

As the compound having the structure (2) as the aggregation terminating agent, may be mentioned the below-described example compounds (1-20), (1-21), (1-26), and (1-27). Specific examples thereof include morin (example compound (1-20)), kaempferol (example compound (1-21)), apigenin (example compound (1-26)) and diosmin (example compound (1-27)). Also, naringenin (example compound (1-22)), naringin (example compound (1-23)), hesperetin (example compound (1-241), and hesperidin (example compound (1-25)) may be mentioned as the aggregation terminating agent.

EXAMPLE COMPOUND (1-20)

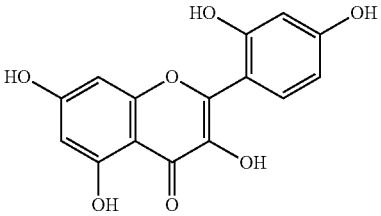

EXAMPLE COMPOUND (1-21)

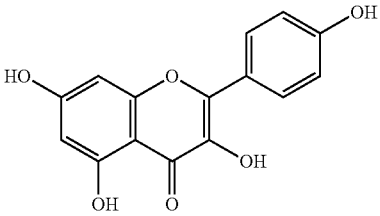

EXAMPLE COMPOUND (1-22)

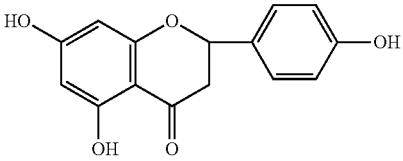

-continued

EXAMPLE COMPOUND (1-23)

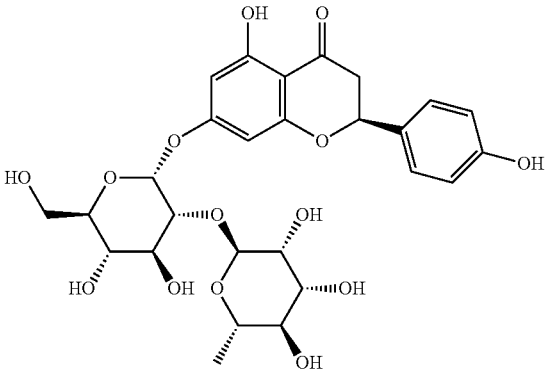

EXAMPLE COMPOUND (1-24)

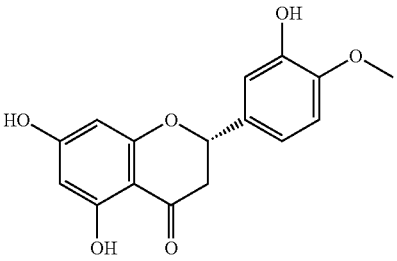

EXAMPLE COMPOUND (1-25)

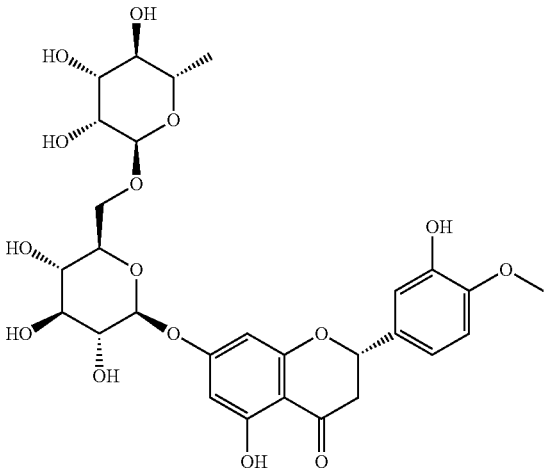

EXAMPLE COMPOUND (1-26)

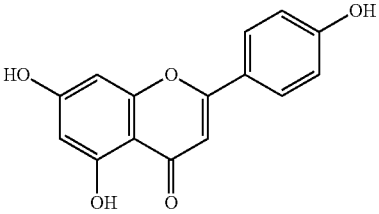

-continued

EXAMPLE COMPOUND (1-27)

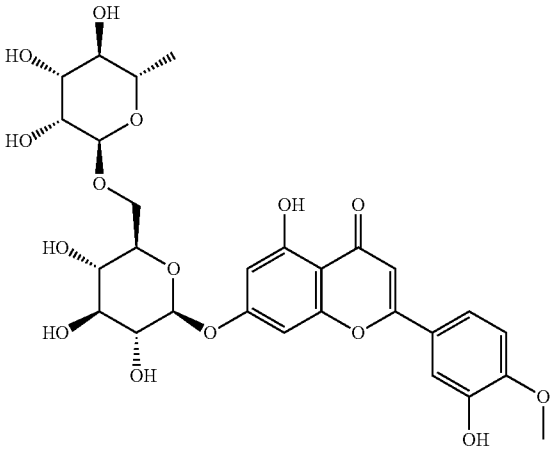

As the compound having both the structure (1) and the structure (2) as the aggregation terminating agent, may be mentioned the below-described example compounds (1-30) to (1-32). Specific: examples thereof include quercetin (example compound (1-30)), rutin (example compound (1-31)) and myricetin (example compound (1-32)).

EXAMPLE COMPOUND (1-30)

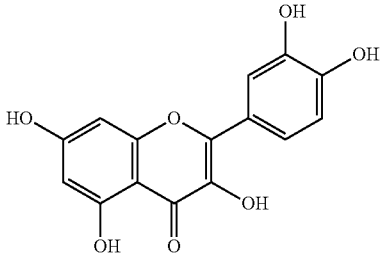

EXAMPLE COMPOUND (1-31)

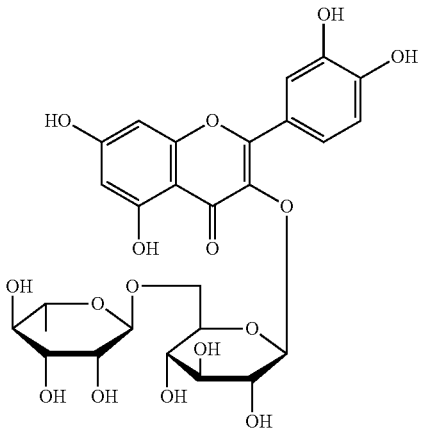

-continued

EXAMPLE COMPOUND (1-32)

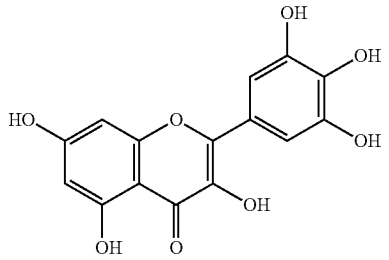

The compound having both the structure (1) and the structure (2) is preferably used as the aggregation terminating agent, from the viewpoint of the ability to control the particle size.

The compounds having the specific structure as an aggregation terminating agent may be used either singly or in any combination thereof.

The amount of the aggregation terminating agent added into the aqueous medium is preferably 1 to 1,000 mmol, more preferably 4 to 400 mmol per 1 L of the aqueous medium in the aggregating system.

(5) Aging Step:

The aging step is conducted as needed. In this aging step, am aging treatment in which the aggregated particles are aged with thermal energy until a desired shape is achieved is conducted.

In the aging step, the heating temperature is, for example, preferably equal to or higher than the glass transition point of the binder resin and equal to or lower than 100° C.

(6) Filtering and Washing Step:

The filtering and washing step may be conducted according to a filtering and washing step generally conducted in a publicly known production process of toner particles.

In the filtering and washing step, the pH of the dispersion system, of the toner particles at the time filtration and washing are specifically conducted is preferably controlled to 1.0 to 5.0. The dispersion system is controlled to such a pH, whereby the aggregating agent, surfactant, colorant, etc. that have not been taken in the toner particles can be effectively washed out.

(7) Drying Step:

The drying step may be conducted according to a drying step generally conducted in a publicly known production process of toner particles.

(8) External Additive Adding Step:

The toner particles described above may be used as a toner as they are. However, what is called external additives such as a flowability improver and a cleaning aid may be added into the toner particles for the purpose of improving flowability, charge property, cleaning ability, etc.

Examples of the flowability improver include inorganic fine particles having a number-average primary particle size of the order of 10 to 1,000 nm. Examples of the inorganic fine particles include fine particles formed of silica, alumina, titanium oxide, zinc oxide, iron oxide, copper oxide, lead oxide, antimony oxide, yttrium oxide, magnesium oxide, barium, titanate, calcium titanate, zinc titanate, ferrite, red iron oxide, magnesium fluoride, silicon, carbide, boron carbide, silicon nitride, zirconium nitride, magnetite, magnesium stearate, calcium stearate, zinc stearate, etc.

These inorganic fine particles are preferably subjected to a surface treatment with a silane coupling agent, titanium coupling agent, higher fatty acid, silicone oil or the like for the purpose of improving dispersibility on the surfaces of the toner particles and environmental stability.

Examples of the cleaning aid include organic fine particles having a number-average primary particle size of the order of 10 to 2,000 nm, such as fine polystyrene particles, fine polymethyl methacrylate particles and fine styrene-methyl methacrylate copolymer particles.

Various fine particles may also be used as the external additive in combination.

The total amount of these external additives added is preferably 0.05 to 5 parts by mass, more preferably 0.1 to 3 parts by mass per 100 parts by mass of the toner particles.

As a mixing device for the external additives, may be used a mechanical mixing device such as a mixer "HENSCHEL MIXER" and a coffee mill.

According to the toner obtained by the toner production process described above, excellent charging characteristics can be developed, thereby forming a visible image having high image quality.

Particle Size of Toner:

The particle size of the toner is, for example, preferably 3 to 8 μm, more preferably 5 to 8 μm in terms of a volume-based median diameter. This particle size can be controlled by the concentration of the aggregating agent used upon the production, the amount of the organic solvent added, a fusion-bonding time and/or the composition of the binder resin.

The volume-based median diameter fails within the above range, whereby a very minute dot image of a level of 1,200 dpi can be faithfully reproduced.

In the present invention, the volume-based median diameter of the toner is a value measured and calculated by means of a measuring device with a computer system, in which a data processing software "Software V3.51" is mounted, connected to an analyzer "MULTISIZER 3" (manufactured by Beckmann Coulter Co.).

Specifically, 0.02 g of the sample (toner) is added to 20 mL of a surfactant solution (for example, a surfactant solution obtained by diluting a neutral detergent containing a surfactant component with pure water to 10 times for the purpose of dispersing the toner particles) to cause the toner to be intimate, and ultrasonic dispersion is then conducted for 1 minute to prepare a dispersion of the sample. This sample dispersion is poured into a beaker, in which "ISOTON II" (manufactured by Beckmann Coulter Co.) has been placed, within a sample stand by a pipette until an indicator concentration of the measuring device reaches 8%. Here, the concentration is controlled to this range, whereby a reproducible measured value can be obtained. In the measuring device, the number of particles to be measured is counted as 25,000 particles, and an aperture diameter is controlled to 100 μm to calculate frequency values with a range of 2 to 60 μm that is a measuring range divided into 256 portions. A particle size of 50% from the largest integrated volume fraction is regarded as a volume-based median diameter.

Particle Size Distribution of Toner:

A coefficient of variation (Cv value) in a volume-based particle size distribution of the toner is preferably 2 to 22%, more preferably 5 to 20%.

The coefficient of variation (Cv value) in the volume-based particle size distribution means that the degree of dispersion in the particle size distribution of the toner is expressed on the basis of volume and defined according to the following equation (x):

Cv value(%)=(Standard deviation in particle size distribution by number)/(Median diameter in particle size distribution by number)×100. Equation (x)

A smaller Cv value indicates that the particle size distribution is sharper and means that the size of the toner particles is more uniform. That is, the Cv value falls within the above range, whereby toner particles whose size is uniform come to be obtained, so that a minute dot image or a fine line required for image formation by a digital system can be reproduced at higher precision. When a photographic image is formed, a high-quality photographic image of a level equal to or higher than an image prepared with a printing ink can be formed by using a small-diameter toner uniform in size.

Average Roundness of Toner:

The average roundness of the toner is preferably 0.930 to 1.000, more preferably 0.950 to 0.995, from the view point of stability of charging characteristics and low temperature fixability.

The average roundness falls within the above range, whereby each toner particle is unlikely to fracture and contamination of a friction charge-providing member is suppressed, so that charge property of the toner is stabilised. Also the packing density of the toner particles in the toner layer transferred on a recording material is increased and fixability is improved so that fixing offset becomes unlikely to occur.

In the present invention, the average roundness of the toner is measured by means of "FPIA-2100" (manufactured by Sysmex Corporation).

Specifically, the average roundness is a value obtained by blending a sample (toner) with an aqueous solution containing a surfactant; performing an ultrasonic dispersion treatment for 1 minute for dispersing the blended toner; taking a photograph at a proper concentration of an HPF detection number of 3,000 to 10,000 in a measuring condition HPF (high magnification photographing) mode by means of "FPIA-2100" (manufactured by Sysmex Corporation); calculating the roundness for each particle in accordance with a formula (y) below; summing up the roundness of each particle; and dividing the summed value by the total number of particles. If the HPF detection number falls within the above range, reproducibility is obtained.

Roundness=(Perimeter of circle having same projected area as particle image)/(Perimeter of particle projected image) Formula (y)

Developer:

The toner obtained by the production process according to the present invention may be used as a magnetic or non-magnetic one-component developer, but may also be mixed with a carrier to be used as a two-component developer. When the toner is used as the two-component developer, as the carrier, may be used magnetic particles composed of a conventionally known material such as a metal such as iron, ferrite or magnetite, or an alloy of each of these metals with a metal such as aluminum or lead. In particular, ferrite particles are preferred. As the carrier, may also be used a coated carrier with the surfaces of magnetic particles coated with, a coating agent such as a resin, or a dispersion type carrier with fine magnetic powder dispersed in a binder resin.

The particle size of the carrier in terms of a volume-based median diameter is preferably 20 to 100 μm, more preferably 25 to 80 μm.

In the present invention, the volume-based median diameter of the carrier is measured typically by means of a laser diffraction type particle size distribution measuring device "HELOS" (manufactured by SYMPATEC Co.) equipped with a wet dispersing machine.

As examples of preferred carriers, may be mentioned a resin-coated carrier with the surfaces of magnetic particles coated with a resin, and what is called a resin-dispersion type carrier with, magnetic particles dispersed in a resin. No particular limitation is imposed on the resin making up the resin-coated carrier. Examples thereof include olefin resins, styrene resins, styrene-acrylic resins, acrylic resins, silicone resins, ester resins and fluorine-containing polymer resins. As the resin making up the resin-dispersion type carrier, a publicly known resin may be used without being particularly limited. For example, acrylic resins, styrene-acrylic resins, polyester resins, fluorine resins and phenol resins may be used.

The embodiments of the present invention have been specifically described above. However, embodiments of the present invention are not limited to the above embodiments, and various changes or modifications may be added thereto.

For example, the production process of the toner according to the present invention may also be applied to the production of a toner comprising toner particles of a core-shell structure, which are composed of core particles containing a binder resin and a shell layer covering the peripheral surfaces of the core particles and formed of a shell resin.

According to the present invention, the compound having a specific structure is used as the aggregation terminating agent in the aggregation terminating step, whereby excellent aggregation-relaxing effect is obtained. As a result, the particle size and the particle size distribution can be effectively controlled. Further, the aggregation terminating agent does not contain metal salts, whereby the amount of metal salts used during the production is reduced, so that the content of metal elements derived from the metal salts contained in the resultant toner is reduced. Thus, a toner having excellent charging characteristics can be produced.

EXAMPLES

Specific examples of the present invention will hereinafter be described. However, the present invention is not limited thereto. Measurements of the volume-based median diameter of fine binder resin particles, the volume-based median diameter of fine colorant particles, the volume-based median diameter of a toner and the Cv value were respectively conducted as those described above.

Production Example 1 of Toner; Example 1

(1) Fine Colorant Particle Dispersion-Preparing Step

One hundred parts by mass of carbon black "REGAL 330R" (manufactured by Cabot Corporation) as a colorant was gradually added into 900 parts by mass of a 10% by mass aqueous solution of sodium dodecyl sulfate with stirring, and a dispersion treatment was then conducted by means of a stirring device "CLEARMIX" (manufactured by M Technique Co. Ltd.), thereby preparing a fine colorant particle dispersion [1]. The particle size of the fine colorant particles dispersed in this fine colorant particle dispersion [1] was found to be 150 nm in terms of a volume-based median diameter.

(2) Fine Binder Resin Particle Dispersion-Preparing Step

In a flask equipped with a stirrer, 448 parts by mass of styrene, 165 parts by mass of n-butyl acrylate, 16 parts by mass of methacrylic acid, 2 parts by mass of n-octylmercaptan and 80 parts by mass of paraffin wax "HNP-57" (manufactured by Nippon Seiro Co., Ltd.) were heated to 90° C. and dissolved to prepare a monomer solution.

On the other hand, a surfactant solution with 8 parts by mass of sodium dodecylbenzenesulfonate dissolved in 1,780 parts by mass of ion-exchanged water was placed in a reaction vessel equipped with a stirrer, a temperature sensor, a condenser tube and a nitrogen inlet device and heated to 98° C., and the above-described monomer solution, was mixed and dispersed in this surfactant solution for 8 hours by means of a mechanical dispersing machine "CLEARMIX" (manufactured by M Technique Co., Ltd.) having a circulating path to prepare a dispersion, containing emulsified particles having a dispersion particle size of 330 nm.

An initiator solution with 10 parts by mass of potassium persulfate dissolved in 400 parts by mass of ion-exchanged water was then added into this dispersion, and this was heated and stirred over 12 hours at 80° C., thereby conducting polymerization to prepare a fine binder resin particle dispersion. [1]. The particle size of the fine binder resin particles dispersed in this fine binder resin particle dispersion [1] was found to be 190 nm in terms of a volume-based, median diameter.

(3) Aggregating Step

In a reaction vessel equipped with a stirrer, a temperature sensor and a nitrogen inlet device, 2, 105 parts by mass of fine binder resin particle dispersion [1], 900 parts by mass of ion-exchanged water and 200 parts by mass of fine colorant, particle dispersion [1] were placed and stirred. The temperature within the vessel was controlled to 30° C., and then a 5N aqueous solution of sodium hydroxide was added to control the pH of the resultant mixture to 10. Then, an aqueous solution, in which 17 parts by mass (an amount with which the amount of magnesium chloride hexahydrate becomes 33 mmol per 1 L of the aqueous medium in the fine binder resin particle dispersion) of magnesium chloride hexahydrate was dissolved in 100 parts by mass of ion-exchanged, water, was added as the aggregating agent over 10 minutes at 30° C. under stirring. After left to stand for 3 minutes, the heating of the system was started to raise the temperature to 85° C. over 60 minutes, thereby aggregating the fine binder resin particles and the fine colorant particles to grow aggregated, particles.

(4) Aggregation Terminating Step

The particle size of the aggregated particles was measured by means of an analyzer "MULTISIZER 3" (manufactured by Beckmann Coulter Co.), and at the time the volume-based median diameter became 6.5 μm, a solution, in which 48.5 parts by mass (an amount with which the amount of catechin becomes 65 mmol per 1 L of the aqueous medium in the aggregating system) of catechin (example compound (1-1)) was dissolved in 350 parts by mass of ion-exchanged water, was added as the aggregation terminating agent into the aggregating system, thereby terminating the growth of the aggregated particles.

(5) Aging Step, Filtering and Washing Step, and Drying Step

Heating and stirring was conducted at a liquid temperature of 85° C. over 3 hours as an aging treatment, thereby fusion-bonding the aggregated particles. Cooling was then conducted down to 30° C. under a condition of G° C./min, and hydrochloric acid was added to control the pH of the dispersion to 4. Then, stirring was terminated. The toner particles were separated from the dispersion system of the toner particles by filtration, and washing with ion-exchanged water was repeated four times. Thereafter, the toner particles were dried with hot air at 40° C., thereby obtaining toner particles [1].

(6) External Additive Adding Step

One percent by mass of hydrophobic silica (number average primary particle size: 12 nm, degree of hydrophobization: 68) and 1% by mass of hydrophobic titanium oxide (number average primary particle size: 20 nm, degree of hydrophobization: 63) were added to the resultant toner particles [1] and mixed by a mixer "HENSCHEL MIXER" (manufactured by Mitsui Miike Engineering Corporation). Thereafter, coarse particles were removed by means of a sieve having a sieve opening of 45 μm, thereby producing a toner [1].

The volume-based median diameter and Cv value of this toner [1] were found to be 6.63 μm and 22.2% respectively.

Production Examples 2 to 9 of Toner; Examples 2 to 9

Toners [2] to [9] were produced in the same manner as in Production Example 1 of toner, except that the aggregating agent used in (3) Aggregating step and the aggregation terminating agent used in (4) Aggregation terminating step were changed to those shown in Table 1.

Production Example 10 of Toner; Comparative Example 1

A toner [10] was produced, in the same manner as in Production Example 1 of toner, except that the aggregation terminating agent used in (4) Aggregation terminating step was changed to a solution in which 113 parts by mass of sodium chloride were dissolved in 350 ml of pure water.

Production Example 11 of Toner; Comparative Example 2

A toner [11] was produced in the same manner as in Production Example 1 of toner, except that the aggregation terminating agent was not used in (4) Aggregation terminating step.

TABLE 1

| | TONER NO. | AGGREGATING AGENT | AGGREGATION TERMINATING AGENT | VOLUME-BASED MEDIAN DIAMETER (μm) | CV VALUE (%) |
|---|---|---|---|---|---|
| EXAMPLE 1 | [1] | MAGNESIUM CHLORIDE HEXAHYDRATE | CATECHIN EXAMPLE COMPOUND (1-1) | 6.63 | 22.2 |
| EXAMPLE 2 | [2] | POLYSILICATO-IRON | CATECHIN EXAMPLE COMPOUND (1-1) | 6.57 | 20.7 |

TABLE 1-continued

| | TONER NO. | AGGREGATING AGENT | AGGREGATION TERMINATING AGENT | VOLUME-BASED MEDIAN DIAMETER (μm) | CV VALUE (%) |
|---|---|---|---|---|---|
| EXAMPLE 3 | [3] | POLYSILICATO-IRON | QUERCETIN EXAMPLE COMPOUND (1-30) | 6.48 | 20.9 |
| EXAMPLE 4 | [4] | IRON CHLORIDE | QUERCETIN EXAMPLE COMPOUND (1-30) | 6.55 | 20.1 |
| EXAMPLE 5 | [5] | ZINC CHLORIDE | QUERCETIN EXAMPLE COMPOUND (1-30) | 6.61 | 21.3 |
| EXAMPLE 6 | [6] | ALUMINUM CHLORIDE | QUERCETIN EXAMPLE COMPOUND (1-30) | 6.59 | 20.8 |
| EXAMPLE 7 | [7] | POLYSILICATO-IRON | MYRICETIN EXAMPLE COMPOUND (1-32) | 6.45 | 18.7 |
| EXAMPLE 8 | [8] | POLYSILICATO-IRON | PYROGALLOL EXAMPLE COMPOUND (1-7) | 6.65 | 23.3 |
| EXAMPLE 9 | [9] | POLYSILICATO-IRON | CATECHOL EXAMPLE COMPOUND (1-8) | 6.66 | 22.6 |
| COMPARATIVE EXAMPLE 1 | [10] | MAGNESIUM CHLORIDE HEXAHYDRATE | SODIUM CHLORIDE | 6.45 | 18.5 |
| COMPARATIVE EXAMPLE 2 | [11] | MAGNESIUM CHLORIDE HEXAHYDRATE | — | 7.31 | 26.3 |

Evaluation

With respect to each of the obtained toners [1] to [11], a developer consisting of 1 g of the toner and 19 g of an acrylic resin coated ferrite carrier having a volume average particle size of 32 μm was placed in a 20 cc glass bottle, and left to stand in each of an HH environment (temperature: 30° C., humidity: 80% RH), an NN environment (temperature: 20° C., humidity: 50% RH) and an LL environment (temperature: 10° C., humidity: 20% RH) for 24 hours. Thereafter, the resultant developer was shaken by means of a shaker "YS-LD" (manufactured by Yayoi Co., Ltd.) at a shaking angle of 45 degree and at 200 strokes/minute for 20 minutes, so that the toner and the carrier were charged.

The developer was slidingly arranged between parallel plate (aluminum) electrodes, and the toner was developed in the condition of a gap between electrodes of 0.5 mm, a DC bias of 1.0 kV, and an AC bias of 4.0 kV and 2.0 kHz. The charge amount and mass of the developed toner were measured, and a charge amount per unit mass Q/m (μC/g) was determined as a charged amount. The result is shown in Table 2.

From the above result, it was confirmed that, according to Examples 1 to 9 regarding the production process of the present invention, the compound having a specific structure was used as the aggregation terminating agent, whereby the particle size (volume-based median diameter) and the particle size distribution (Cv value) could be effectively controlled. It was also confirmed that a toner having excellent charging characteristics could be obtained.

The invention claimed is:

1. A production process of a toner for electrostatic image development, which is composed of toner particles containing a binder resin, the process comprising:

an aggregating step of adding an aggregating agent composed of a compound having a divalent or trivalent metal element into a dispersion in which fine particles of the binder resin have been dispersed in an aqueous medium, thereby aggregating the fine particles of the binder resin to form aggregated particles; and an aggregation terminating step of adding an aggregation terminating agent into an aggregating system of the aggregated particles, thereby terminating the growth of the aggregated particles, wherein

TABLE 2

| | TONER NO. | CHARGED AMOUNT (μC/g) HH ENVIRONMENT | NN ENVIRONMENT | LL ENVIRONMENT |
|---|---|---|---|---|
| EXAMPLE 1 | [1] | 34.1 | 38.2 | 42.3 |
| EXAMPLE 2 | [2] | 33.4 | 36.2 | 40.7 |
| EXAMPLE 3 | [3] | 33.2 | 37.5 | 39.8 |
| EXAMPLE 4 | [4] | 31.5 | 36.5 | 39.2 |
| EXAMPLE 5 | [5] | 30.6 | 35.9 | 39.1 |
| EXAMPLE 6 | [6] | 33.1 | 37.7 | 39.6 |
| EXAMPLE 7 | [7] | 36.3 | 36.5 | 40.3 |
| EXAMPLE 8 | [8] | 27.1 | 32.3 | 37.5 |
| EXAMPLE 9 | [9] | 29.3 | 34.6 | 38.5 |
| COMPARATIVE EXAMPLE 1 | [10] | 22.2 | 35.0 | 46.1 |
| COMPARATIVE EXAMPLE 2 | [11] | 29.7 | 35.2 | 41.5 |

the aggregation terminating agent is composed of a compound having both a structure (1) represented by a formula (1) below and a structure (2) represented by a formula (2) below,

FORMULA (1)

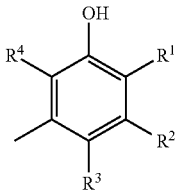

in the formula (1), $R^1$ to $R^4$ each represent a hydrogen atom, a hydroxy group or an organic group, and these may be the same or different from each other; however, at least one of $R^1$ and $R^4$ represents a hydroxy group; and, at least two of $R^1$ to $R^3$ may be bonded together to form a monocyclic structure or a polycyclic structure,

FORMULA (2)

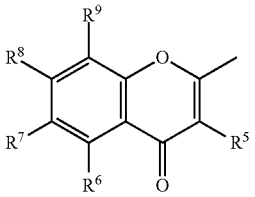

in the formula (2), $R^5$ to $R^9$ each independently represent a hydrogen atom, a hydroxy group or an organic group, however, at least one of $R^5$ and $R^6$ represents a hydroxy group.

2. The production process of the toner for electrostatic image development according to claim 1, wherein the aggregating agent is composed of Fe, Zn or Al as the divalent or trivalent metal element.

3. The production process of the toner for electrostatic image development according to claim 1, wherein the aggregation terminating agent is any one of quercetin, rutin and myricetin.

4. The production process of the toner for electrostatic image development according to claim 1, wherein the amount of the aggregation terminating agent added into the aqueous medium is 1 to 1,000 mmol per 1 L of the aqueous medium in the aggregating system.

5. The production process of the toner for electrostatic image development according to claim 4, wherein the amount of the aggregation terminating agent added into the aqueous medium is 4 to 400 mmol per 1 L of the aqueous medium in the aggregating system.

6. The production process of the toner for electrostatic image development according to claim 4, wherein the amount of the aggregating agent added into the aqueous medium is 1 to 500 mmol per 1 L of the aqueous medium in the dispersion.

7. The production process of the toner for electrostatic image development according to claim 1, wherein the aggregating agent is polysilicato-iron.

8. The production process of the toner for electrostatic image development according to claim 1, wherein the average particle size of the fine particles of the binder resin in the dispersion falls within a range of 20 to 400 nm in terms of a volume-based median diameter.

9. The production process of the toner for electrostatic image development according to claim 1, wherein a polyester resin having an acid value of 40 mg KOH/g or less and a hydroxyl value of 60 mg KOH/g or less is used as the binder resin.

10. A production process of a toner for electrostatic image development, which is composed of toner particles containing a binder resin, the process comprising:

an aggregating step of adding polysilicato-iron as an aggregating agent into a dispersion in which fine particles of the binder resin have been dispersed in an aqueous medium, thereby aggregating the fine particles of the binder resin to form aggregated particles; and an aggregation terminating step of adding an aggregation terminating agent into an aggregating system of the aggregated particles, thereby terminating the growth of the aggregated particles, wherein the aggregation terminating agent is composed of a compound having at least one of a structure (1) represented by a formula (1) below and a structure (2) represented by a formula (2) below,

FORMULA (1)

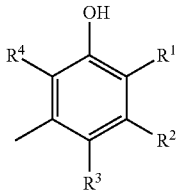

in the formula (1), $R^1$ to $R^4$ each represent a hydrogen atom, a hydroxy group or an organic group, and these may be the same or different from each other; however, at least one of $R^1$ and $R^4$ represents a hydroxy group; and, at least two of $R^1$ to $R^3$ may be bonded together to form a monocyclic structure or a polycyclic structure,

FORMULA (2)

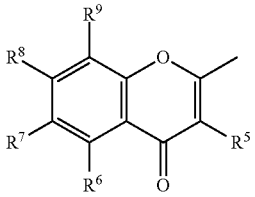

in the formula (2), $R^5$ to $R^9$ each independently represent a hydrogen atom, a hydroxy group or an organic group, however, at least one of $R^5$ and $R^6$ represents a hydroxy group.

11. The production process of the toner for electrostatic image development according to claim 10, wherein the aggregation terminating agent is any one of catechin, epicatechin, epigallocatechin, epigallocatechin gallate, chlorogenic acid, ellagic acid, pyrogallol, catechol, 1,2,3,5-tetrahydroxybenzene, hexahydroxybenzene, morin, kaempferol, apigenin, diosmin, quercetin, rutin and myricetin.

12. The production process of the toner for electrostatic image development according to claim 10, wherein the aggregation terminating agent is composed of a compound having a structure in which $R^1$ and $R^4$ each are a hydroxy group in the formula (1).

13. The production process of the toner for electrostatic image development according to claim 10, wherein the aggregation terminating agent is any one of epigallocatechin, epigallocatechin gallate, pyrogallol, 1,2,3,5-tetrahydroxybenzene and hexahydroxybenzene.

14. The production process of the toner for electrostatic image development according to claim 10, wherein the amount of the aggregation terminating agent added into the aqueous medium is 1 to 1,000 mmol per 1 L of the aqueous medium in the aggregating system.

15. The production process of the toner for electrostatic image development according to claim 14, wherein the amount of the aggregation terminating agent added into the aqueous medium is 4 to 400 mmol per 1 L of the aqueous medium in the aggregating system.

16. The production process of the toner for electrostatic image development according to claim 14, wherein the amount of the aggregating agent added into the aqueous medium is 1 to 500 mmol per 1 L of the aqueous medium in the dispersion.

17. The production process of the toner for electrostatic image development according to claim 10, wherein the average particle size of the fine particles of the binder resin in the dispersion falls within a range of 20 to 400 nm in terms of a volume-based median diameter.

18. The production process of the toner for electrostatic image development according to claim 10, wherein a polyester resin having an acid value of 40 mg KOH/g or less and a hydroxyl value of 60 mg KOH/g or less is used as the binder resin.

19. A production process of a toner for electrostatic image development, which is composed of toner particles containing a binder resin, the process comprising:

an aggregating step of adding an aggregating agent composed of a compound having a divalent or trivalent metal element into a dispersion in which fine particles of the binder resin have been dispersed in an aqueous medium, thereby aggregating the fine particles of the binder resin to form aggregated particles, the binder resin being a polyester resin having an acid value of 40 mg KOH/g or less and a hydroxyl value of 60 mg KOH/g or less; and an aggregation terminating step of adding an aggregation terminating agent into an aggregating system of the aggregated particles, thereby terminating the growth of the aggregated particles, wherein the aggregation terminating agent is composed of a compound having at least one of a structure (1) represented by a formula (1) below and a structure (2) represented by a formula (2) below,

FORMULA (1)

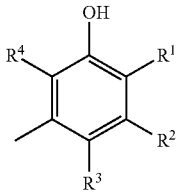

in the formula (1), $R^1$ to $R^4$ each represent a hydrogen atom, a hydroxy group or an organic group, and these may be the same or different from each other; however, at least one of $R^1$ and $R^4$ represents a hydroxy group; and, at least two of $R^1$ to $R^3$ may be bonded together to form a monocyclic structure or a polycyclic structure,

FORMULA (2)

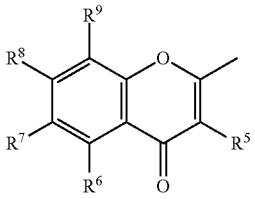

in the formula (2), $R^5$ to $R^9$ each independently represent a hydrogen atom, a hydroxy group or an organic group, however, at least one of $R^5$ and $R^6$ represents a hydroxy group.

20. The production process of the toner for electrostatic image development according to claim 19, wherein the aggregation terminating agent is any one of catechin, epicatechin, epigallocatechin, epigallocatechin gallate, chlorogenic acid, ellagic acid, pyrogallol, catechol, 1,2,3,5-tetrahydroxybenzene, hexahydroxybenzene, morin, kaempferol, apigenin, diosmin, quercetin, rutin and myricetin.

21. The production process of the toner for electrostatic image development according to claim 19, wherein the aggregation terminating agent is composed of a compound having a structure in which $R^1$ and $R^4$ each are a hydroxy group in the formula (1).

22. The production process of the toner for electrostatic image development according to claim 19, wherein the aggregation terminating agent is any one of epigallocatechin, epigallocatechin gallate, pyrogallol, 1,2,3,5-tetrahydroxybenzene and hexahydroxybenzene.

23. The production process of the toner for electrostatic image development according to claim 19, wherein the amount of the aggregation terminating agent added into the aqueous medium is 1 to 1,000 mmol per 1 L of the aqueous medium in the aggregating system.

24. The production process of the toner for electrostatic image development according to claim 23, wherein the amount of the aggregation terminating agent added into the aqueous medium is 4 to 400 mmol per 1 L of the aqueous medium in the aggregating system.

25. The production process of the toner for electrostatic image development according to claim 23, wherein the amount of the aggregating agent added into the aqueous medium is 1 to 500 mmol per 1 L of the aqueous medium in the dispersion.

26. The production process of the toner for electrostatic image development according to claim 19, wherein the average particle size of the fine particles of the binder resin in the dispersion falls within a range of 20 to 400 nm in terms of a volume-based median diameter.

* * * * *